US008094829B2

(12) United States Patent
Osada

(10) Patent No.: US 8,094,829 B2
(45) Date of Patent: Jan. 10, 2012

(54) METHOD FOR PROCESSING SOUND DATA

(75) Inventor: Masataka Osada, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 528 days.

(21) Appl. No.: 12/358,514

(22) Filed: Jan. 23, 2009

(65) Prior Publication Data

US 2009/0190772 A1 Jul. 30, 2009

(30) Foreign Application Priority Data

Jan. 24, 2008 (JP) ..... 2008-013772

(51) Int. Cl.
*H04R 3/02* (2006.01)

(52) U.S. Cl. ..... 381/73.1; 381/94.1; 381/94.2

(58) Field of Classification Search ..... 381/73.1, 381/94.1, 94.2, 94.3; 704/219, 233
See application file for complete search history.

(56) References Cited

U.S. PATENT DOCUMENTS

| | | | | |
|---|---|---|---|---|
| 6,098,036 | A * | 8/2000 | Zinser et al. | 704/219 |
| 6,351,731 | B1 * | 2/2002 | Anderson et al. | 704/233 |
| 7,171,003 | B1 * | 1/2007 | Venkatesh et al. | 381/66 |
| 2006/0025994 | A1 * | 2/2006 | Christoph | 704/229 |
| 2009/0097670 | A1 * | 4/2009 | Jeong et al. | 381/73.1 |

FOREIGN PATENT DOCUMENTS

JP 2004-061617 A 2/2004

* cited by examiner

*Primary Examiner* — Kevin M Picardat
(74) *Attorney, Agent, or Firm* — Holtz, Holtz, Goodman & Chick, PC

(57) ABSTRACT

Masking thresholds are obtained for each frequency component of sound data and ambient noise. It is determined whether each frequency component of the sound data is masked by at least one of the other frequency components of the sound data. It is further determined whether each frequency component of the sound data is masked by ambient noise. Correction coefficients are set for each frequency component of the sound data according to whether the frequency component is masked by at least one of the other frequency components of the sound data and whether the frequency component is masked by the ambient noise. And each frequency component of the sound data is corrected by using the respective correction coefficients.

7 Claims, 6 Drawing Sheets

METHOD FOR PROCESSING SOUND DATA

CROSS-REFERENCE TO RELATED APPLICATION

The present invention claims the benefit of priority under 35 USC 119 of Japanese Patent Application No. 2008-13772, filed on Jan. 24, 2008, the entire contents of which are incorporated herein by reference.

BACKGROUND OF THE INVENTION

1. Field of the Invention

The present invention relates to a signal processing apparatus.

2. Description of the Related Art

At present, apparatuses which reproduce voices and music, such as televisions or radio broadcast reception/reproduction apparatuses, music players, and portable telephones, are sometimes used in streetcars, in the outdoors, in automobiles, and in similar places where ambient noise exists. In this case, sound data which is reproduced by an apparatus (hereinafter, referred to as "sound data") is masked by the ambient noise, depending upon the frequency or power relation between the sound data and the ambient noise, with the result that the clarity of the sound is lowered in some cases. In many sound reproduction apparatuses, sound data volume can be adjusted by a user. However, the sound volume adjustments cannot be made for the individual frequency components of the sound data. Therefore, the clarity of the sound is not always enhanced by increasing the sound volume. Besides, in a case where the sound data volume has been increased, the power of the whole band of the sound data is amplified. Therefore, the sound is sometimes distorted to a rather worsened sound quality. Further, when the sound volume is increased excessively, there is the possibility that the user's hearing will be damaged.

In this regard, there has been proposed, for telephone conversations in environments where there is ambient noise, a received voice processing apparatus wherein a frequency masking quantity and a time masking quantity ascribable to the ambient noise inputted from a microphone are calculated, and filtering for a received voice signal is performed by setting the filter coefficient of a digital filter on the basis of gains which have been determined for the respective frequency components of the received voice signal in accordance with the masking quantities, whereby even the sound masked by the ambient noise is amplified to an audible level (refer to, for example, JP-A-2004-61617).

According to the technique disclosed in JP-A-2004-61617, the whole band of the sound data is not amplified. Only the frequency component masked by the ambient noise can be amplified. In this case, a sound volume increment can be less than the increment of the sound volume when the whole band is amplified. The technique disclosed in JP-A-2004-61617, however, amplifies all the frequency components masked by the ambient noise. Therefore, a frequency component which is not sensed even when the ambient noise does not exist (a frequency component which is masked by another frequency component of the sound data) is also amplified, thereby unnecessarily increasing the sound volume. Moreover, an abnormal sound might be produced because the frequency component that is not sensed (because it is masked by the other frequency components) is amplified such that it is not masked by the ambient noise.

SUMMARY OF THE INVENTION

In view of the above problems, an object of the present invention is to provide a signal processing apparatus which can clarify sound data while preventing excessive sound volume amplification, in an environment where there is ambient noise.

To achieve this object, a method is provided for processing sound data that includes determining a power and a first masking threshold for each frequency component of sound data. A second masking threshold is obtained for each frequency component of an ambient noise. It is determined whether each frequency component of the sound data is masked by at least one of the other frequency components of the sound data, and it is determined whether each frequency component of the sound data is masked by ambient noise. Correction coefficients are set for each frequency component of the sound data according to whether the frequency component is masked by the at least one of the other frequency components of the sound data and whether the frequency component is masked by the ambient noise. And the frequency components of the sound data are corrected by using the respective correction coefficients.

According to the invention, it is possible to provide a signal processing apparatus which can clarify sound data while preventing excessive sound volume amplification, in an environment where ambient noise exists.

DETAILED DESCRIPTION

A signal processing apparatus according to the present invention may be provided in a portable telephone, a PC, portable audio equipment, or the like. A signal processing apparatus provided in a portable telephone is described below.

Figure 1:
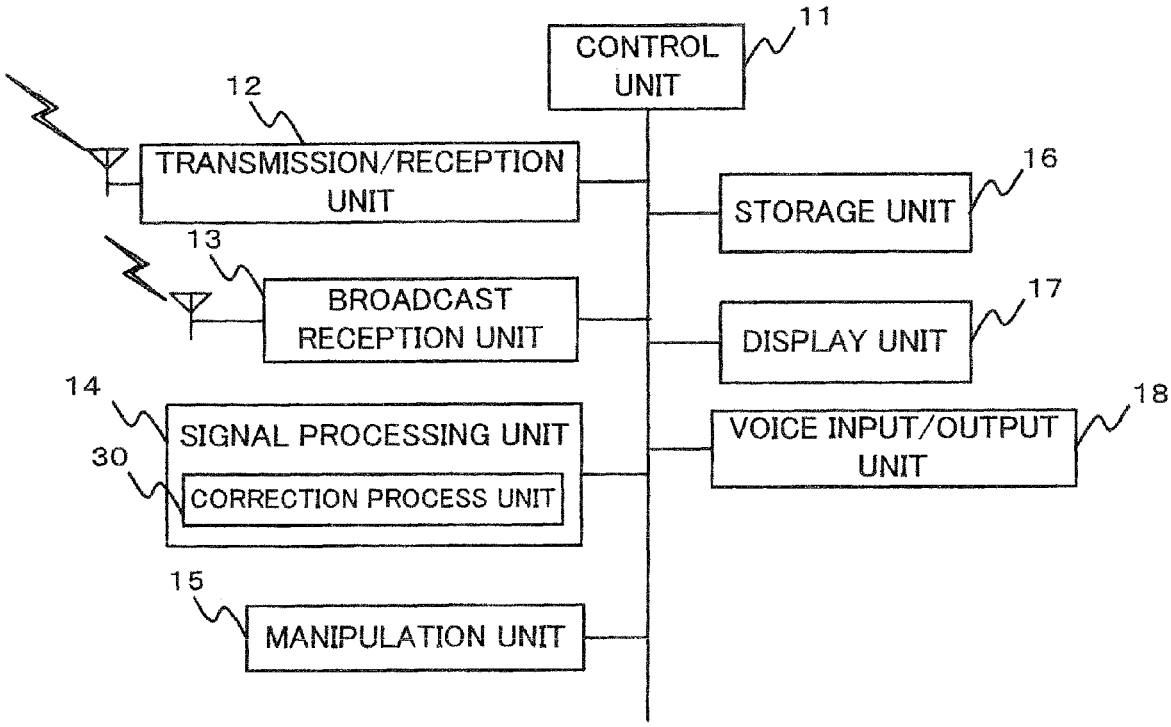
FIG. 1 is a block diagram showing the configuration of a portable telephone according to the first embodiment of the present invention.

FIG. 1 is a configuration diagram of a portable telephone according to an embodiment of the present invention. The portable telephone includes a control unit 11 which controls the whole portable telephone. A transmission/reception unit 12, a broadcast reception unit 13, a signal processing unit 14, a manipulation unit 15, a storage unit 16, a display unit 17, and a voice input/output unit 18 are connected to the control unit 11.

The transmission/reception unit 12 transmits and receives information items between the portable telephone and an access point (not shown). An antenna is connected to the transmission/reception unit 12, and this the transmission/reception unit 12 has a transmission function of transmitting information converted into an electric wave to the access point via the antenna, and a reception function of receiving an electric wave from the access point and converting the electric wave into an electric signal.

An antenna for receiving a TV broadcast is connected to the broadcast reception unit 13. The broadcast reception unit 13 acquires the signal of a selected physical channel, among electric waves inputted by the antenna for the TV broadcast reception.

The signal processing unit 14 processes digital signals such as a video signal and voice signal, and an audio signal. This signal processing unit 14 has a correction process unit 30 which executes a correction process for sound data. The correction process unit 30 executes the correction process so as to clarify the sound data of a voice telephone conversation, a video phone conversation, or the like, as received by the transmission/reception unit 12, the sound data of a television broadcast or radio broadcast as received by the broadcast reception unit 13, music data stored in the storage unit 16, or the like.

The manipulation unit 15 includes input keys, etc., and can be manipulated by a user as an input device. Application software, music data, video data, etc., are stored in the storage unit 16. The display unit 17 is made of a liquid-crystal display, an organic EL display, or the like. The display unit 17 displays an image corresponding to the operating state of the portable telephone.

The voice input/output unit 18 includes a microphone and a loudspeaker. A voice from a TV broadcast or a telephone conversation, or a ringing tone at call reception, etc., are outputted by the loudspeaker. In addition, a voice signal is inputted to the portable telephone through the microphone.

Figure 2:
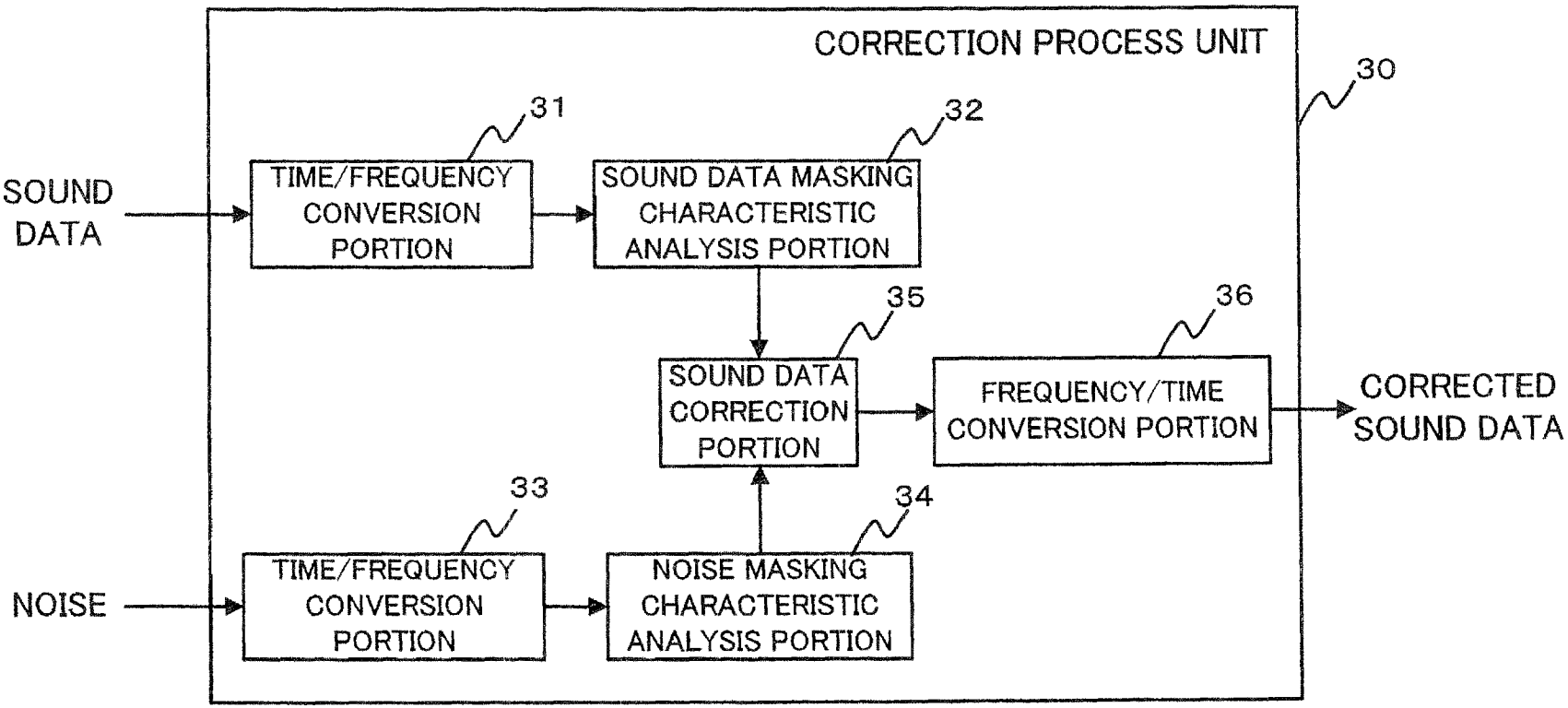
FIG. 2 is a diagram showing the configuration of a correction process unit in the portable telephone according to the first embodiment of the invention.

FIG. 2 is a configuration diagram showing the details of the correction process unit 30. Both ambient noise acquired and A/D-converted by the microphone of the voice input/output unit 18 and sound data to be corrected are inputted to the correction process unit 30. As stated before, the sound data may be the obtained by communications or may be data stored in the storage unit 16.

The sound data inputted to the correction process unit 30 is converted from a time domain into a frequency domain by a time/frequency conversion portion 31. FFT (Fast Fourier Transform) or MDCT (Modified Discrete Cosine Transform), for example, can be employed for the conversion between the time domain and the frequency domain. Hereinafter, description will be made under the assumption that the time/frequency conversion has been performed by employing FFT. When the time/frequency conversion is performed by setting the number of FFT points at N, the values of N frequency components are obtained.

The sound data converted into the frequency domain by the time/frequency conversion portion 31 is inputted to a sound data masking characteristic analysis portion 32. In the sound data masking characteristic analysis portion 32, the power levels of the sound data and masking threshold values are calculated for the respective frequency components.

The power of the sound data for each frequency component "signal_power[i]" is calculated by formula (1) with the value of the real part of the frequency component (signal_r[i]) and the imaginary part of the frequency component (signal_i[i]) Here, "i" denotes the indexes of the N frequency components, and the power "signal_power[i]" of the sound data for each frequency component from "i=0" to "i=(N−1)" is found.

$$\text{signal_power}[i]=\text{signal_}r[i]^2+\text{signal_}i[i]^2 \quad (1)$$

The masking threshold value is calculated using the power of the sound data. The masking threshold value can be calculated by convoluting a function called a "spreading function" into the signal power. The spreading function is elucidated in, for example, the documents ISO/IEC13818-7, ITU-R1387, and 3GPP TS 26.403. Here, a scheme elucidated in ISO/IEC13818-7 shall be employed and explained, but any other scheme may be employed. In the scheme of ISO/IEC13818-7, the spreading function is defined by the following formulas:

if b2>=b1

$tmpx=3.0(b2-b1)$ else $tmpx=1.5(b1-b2)$ $tmpz=8\times\text{minimum}((tmpx-0.5)^2-2(tmpx-0.5), 0)$ $tmpy=15.811389+7.5(tmpx+0.474)-17.5(1.0+(tmpx+0.474)^2)^{0.5}$.

if $tmpy<-100$ $sprdngf(b1, b2)=0$ else $sprdngf(b1, b2)=10\hat{}((tmpz+tmpy)/10)$ A function "sprdngf( )" denotes the spreading function. In addition, "b1" and "b2" indicate values obtained by converting the frequency values into a scale called "bark scale". The bark scale is set finer in a low-frequency range and coarser in a high-frequency range in consideration of the resolution of the sense of hearing. In the spreading function, the frequency value of the frequency component needs to be converted into a bark value. The formula of conversion from a frequency scale into a bark scale is represented by formula 2.

$$Bark=13\arctan(0.76f/1000)+3.5\arctan((f/7500)2)^* \quad (2)$$

Here, "f" indicates a frequency (Hz) and is represented by the following formula:

$$f=((\text{sampling frequency})/(\text{number of points of FFT}))\times i$$

The bark value corresponding to the index i of the frequency component as obtained by formula (2) shall be denoted as "bark[i]" below.

The spreading function found as stated above and the power of the sound data are convoluted, whereby the masking threshold value of the sound data can be calculated. More specifically, the masking threshold value "signal_thr[i]" of the sound data for the frequency component i thereof is represented by formula (3):

$$\text{signal_thr}[i]=\sum_{j=0}^{j=N-1}\text{signal_power}[j]\times sprdngf(\text{bark}[j], \text{bark}[i]) \quad (3)$$

If the frequency component i has a power level equal to or below the masking threshold value "signal_thr[i]", it is masked by a frequency component of the sound data other than the frequency component i.

The above is the processing of the time/frequency conversion portion 31 and the processing of the sound data masking characteristic analysis portion 32 for the sound data. The ambient sound acquired from the microphone of the voice input/output unit 18 is also subjected to the processing of a time/frequency conversion portion 33 and the processing of a noise masking characteristic analysis portion 34.

In the time/frequency conversion portion 33, the ambient noise is converted from a time domain into a frequency domain. The FFT or MDCT, for example, is considered as the technique of the time/frequency conversion here. It is desirable, however, to adopt the same technique as the technique which is employed for the time/frequency conversion of the sound data in the time/frequency conversion portion 31. Hereinafter, description will be made under the assumption that the same technique, FFT, as in the conversion for the sound data in the time/frequency conversion portion 31 is employed as the conversion technique for the ambient noise in the time/frequency conversion portion 33.

In the noise masking characteristic analysis portion 34, the power of each frequency component "noise_power[i]" is first calculated using the ambient noise converted into the frequency domain that has been inputted from the time/frequency conversion portion 33. A formula for calculating the power of the ambient noise of each frequency component is represented by formula (4).

$$\text{noise_power}[i]=\text{noise_}rf[i]^2+\text{noise_}if[i]^2 \tag{4}$$

In addition, the spreading function stated before is convoluted into this power of the ambient noise, thereby finding the masking threshold value (noise_thr[i]) of the ambient noise at the frequency index i. More specifically, the masking threshold value "noise_thr[i]" of the ambient noise for the frequency component i thereof is represented by formula (3):

$$\text{noise_thr}[i] = \sum_{j=0}^{j=N-1} \text{noise_power}[j] \times sprdngf(\text{bark}[j], \text{bark}[i]) \tag{5}$$

Owing to the above processing, the power levels and the masking threshold values of the sound data and the ambient noise are respectively calculated. The power levels and masking threshold values of the sound data and the frequency spectrum of the sound data as calculated by the time/frequency conversion portion 31 are inputted from the sound data masking characteristic analysis portion 32 to a sound data correction portion 35. In addition, the masking threshold values of the ambient noise are inputted from the noise masking characteristic analysis portion 34 to the sound data correction portion 35. Using the inputted values, the sound data correctionportion 35 executes the correction process for the sound data. The sound data corrected by the sound data correction portion 35 is converted back from the frequency domain to the time domain by the frequency/time conversion portion 36, and is outputted from the correction process unit 30.

Figure 3:
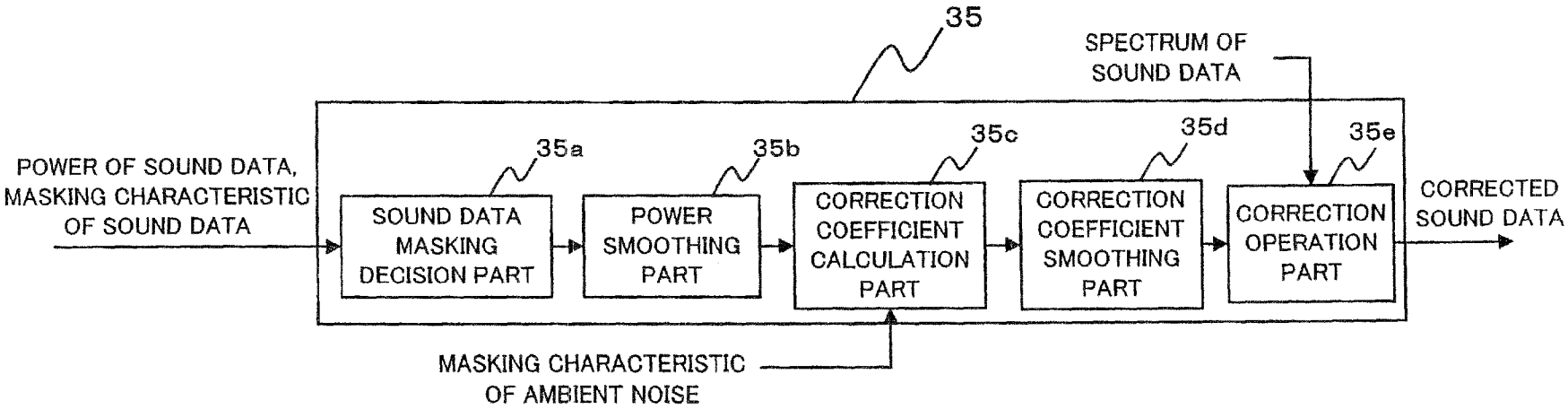
FIG. 3 is a diagram representing in detail a sound data correction portion in the portable telephone according to the first embodiment of the invention.

FIG. 3 is a diagram for explaining the sound data correction portion 35 in detail. The sound data correction portion 35 includes a sound data masking decision part 35*a*, a power smoothing part 35*b*, a correction coefficient calculation part 35*c*, a correction coefficient smoothing part 35*d*, and a correction operation part 35*e*. Parts from the sound data masking decision part 35*a* to the correction coefficient smoothing part 35*d* are for calculating the correction coefficient. The correction operation part 35*e* corrects the sound data using the correction coefficient inputted from the correction coefficient smoothing part 35*d*. The processes of the respective constituent parts will be described in detail below.

The sound data masking decision part 35*a* determines whether each frequency component inputted from the sound data masking characteristic analysis portion 32 is masked by another frequency component of the sound data, by using the power level (also referred to herein as "power") and the masking threshold value of the frequency component of the sound data.

Figure 4:
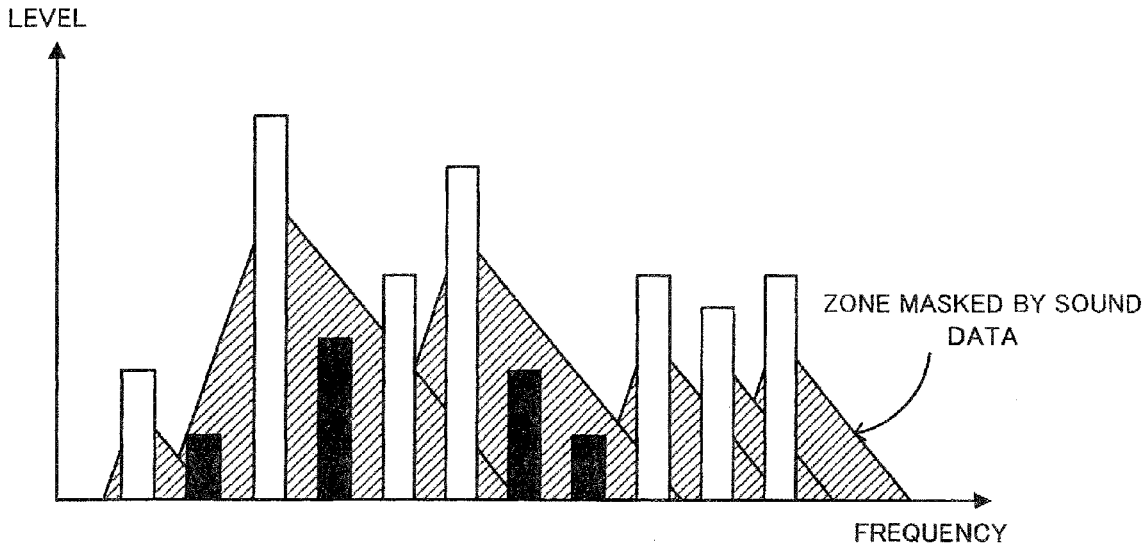
FIG. 4 is a graph representing frequency components which are masked by sound data itself.

FIG. 4 is a diagram showing the masking characteristic of the sound data graphically. In the diagram, the power levels of the respective frequency components are indicated by bars, and zones which are masked by the sound data are indicated by hatched zones. The power levels of frequency components shown by black bars in FIG. 4 are contained in the zones which are masked by the other frequency components of the sound data. These frequency components are signals which cannot be sensed even in the absence of the ambient noise. The frequency components which are not contained in the zones masked by the sound data itself are signals which can be sensed in the absence of the ambient noise.

Therefore, in order to determine whether or not a frequency component is masked by the other frequency components of the sound data, the power of the sound data "signal_power[i]" and the masking threshold value "signal_thr[i]" thereof are compared, and if the power of the sound data is greater than the masking threshold value thereof, information indicating that the frequency component is not masked by another frequency component of the sound data is stored. On the other hand, if the power of the sound data is equal to or less than the masking threshold value thereof, information indicating that the frequency component is masked by another frequency component of the sound data is stored. The sound data masking decision part 35*a* performs this comparison for every frequency component.

The power smoothing part 35*b* smoothes the power of the sound data "signal_power[i]" in a processing stage preceding the correction coefficient calculation part 35*c* which calculates the correction coefficient for the frequency component that is not masked by the sound data itself. The sound quality is smoothed because the ratio between the masking threshold value of the ambient noise and the power of sound data is used for the calculation of the correction coefficient. Therefore, if the correction coefficient is obtained without smoothing the power of the sound data and a correction is made using the obtained correction coefficient, the fine structure of the sound data collapses, and sound quality worsens. By way of example, a method which employs a weighted moving average as in formula (6) is considered for the smoothing of the power of the sound data.

$$\text{signal_power_smth}[i] = \frac{\sum_{j=i-M}^{j=i} a_j \cdot \text{signal_power}[j]}{\sum_{j=i-M}^{j=i} a_j} \tag{6}$$

In formula (6), "M" indicates a smoothing degree. That is, the average is obtained using (M+1) power values. A smoothing coefficient $a_j$ is a weighting such that the frequency component of an index nearer to the index i becomes heavier. When the power of the sound data is smoothed by employing the weighted moving average as in formula (6), the smoothing maybe performed for the whole band of the sound data, or it may be performed for only the frequency components determined to be masked by the sound data itself, by the sound data masking decision part 35*a*. When performing the smoothing over the whole band, either the processing of the sound data masking decision part 35*a* or the processing of the power smoothing part 35*b* may be executed earlier.

In the correction coefficient calculation part 35*c*, a correction coefficient (tmp_coef[i]) for correcting the sound data is obtained using the power of each frequency component of the sound data that has been smoothed by the power smoothing part 35*b*, and the masking threshold value of the ambient noise that has been inputted from the noise masking characteristic analysis portion 34.

Figure 5:
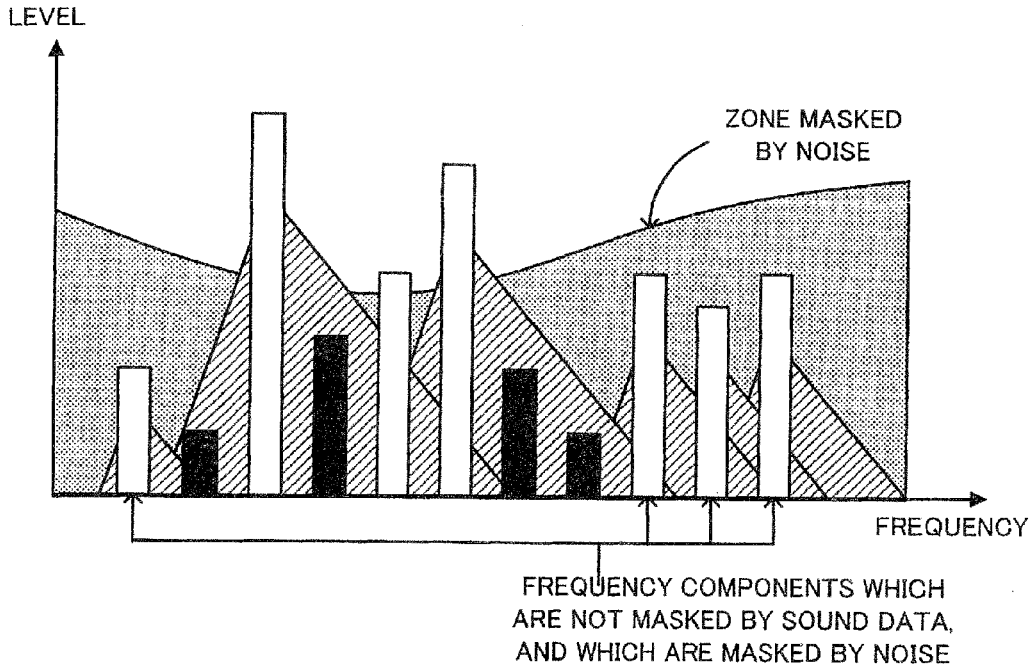
FIG. 5 is a graph representing frequency components which are masked by ambient noise.

FIG. 5 represents the masking by the ambient noise. As shown in the figure, frequency components which are masked by the ambient noise include frequency components masked by the sound data itself and frequency components not masked by the sound data. The frequency components which are masked both by the ambient noise and by the sound data itself are not heard even in the absence of ambient noise. Accordingly, the correction coefficients are set so as not to amplify these frequency components. In contrast, the correction coefficients are set so as to amplify the frequency components which are masked by the ambient noise and which are not masked by the sound data itself.

Figure 6:
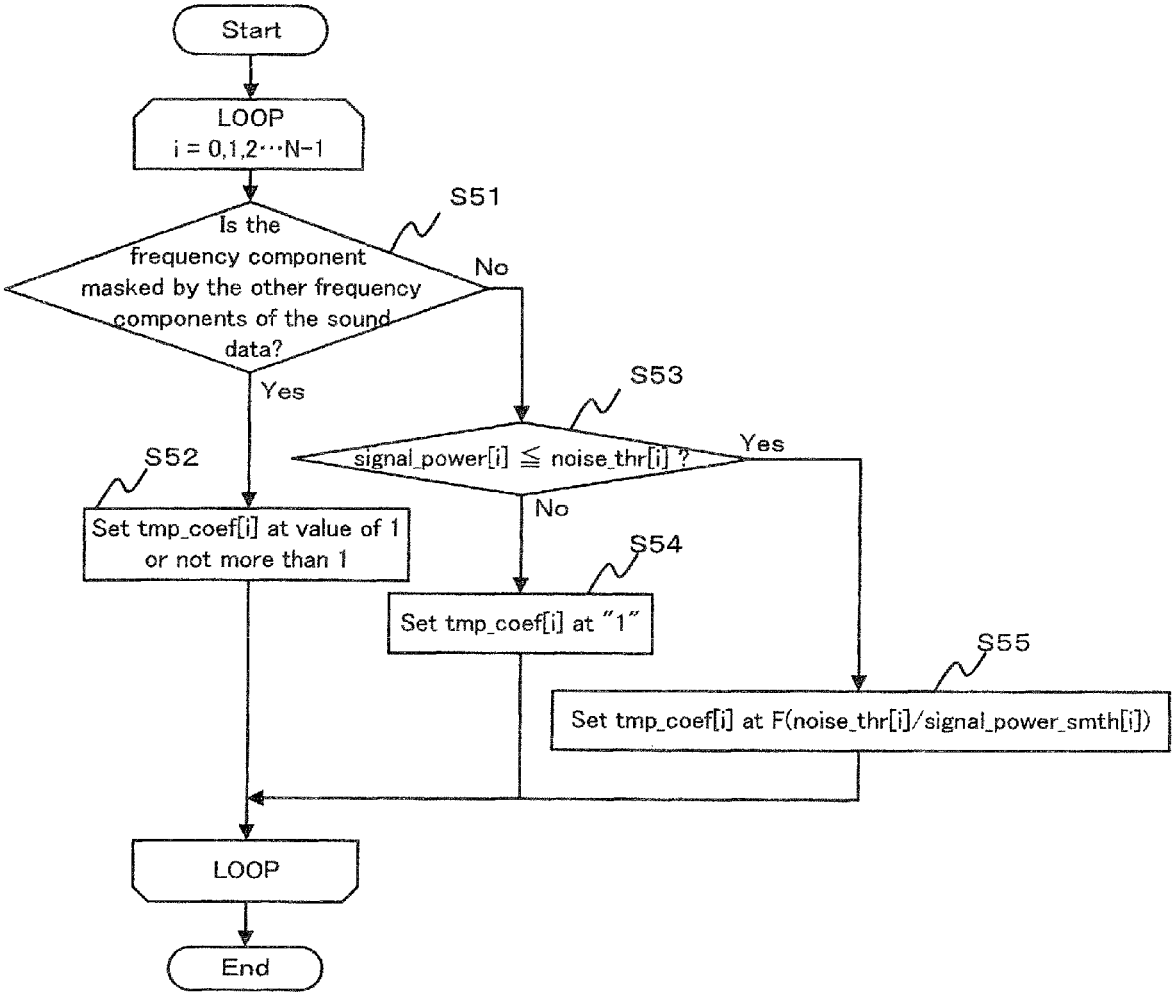
FIG. 6 is a flow chart showing a process in the portable telephone according to the first embodiment of the invention.

The process of the correction coefficient calculation part 35*c* is shown in FIG. 6. In the correction coefficient calculation part 35*c*, the correction coefficient is calculated for every frequency component (for each of N indexes i of "0" to "(N−1)"). First, the correction coefficient calculation part 35*c* selects a frequency component which is indicated by index "i". Then, the correction coefficient calculation part 35*c* acquires the information which indicates whether or not the frequency component is masked by the other frequency components of the sound data as determined by the sound data masking decision part 35*a*.

If the frequency component is masked by the other frequency components of the sound data ("Yes" at a step S51) the correction coefficient tmp_coef[i] is set at a value of 1 or not more than 1. When the correction coefficient is "1", the power of the frequency component is neither amplified nor attenuated even when the correction is made by the correction operation part 35*e*. When the correction coefficient is below "1", the power of the frequency component is attenuated by the correction operation part 35*e*.

On the other hand, if the frequency component is not masked by the sound data itself ("No" at the step S51), the power of the sound data and the masking threshold value of the ambient noise are compared (step S53) If the power of the sound data is greater than the masking threshold value of the ambient noise ("No" at the step S53), the frequency component of the sound data is not masked by the ambient noise, and hence, need not be amplified. Therefore, the correction coefficient tmp_coef[i] for the frequency component is set at "1" (step S54).

If the power of the sound data is equal to or less than the masking threshold value of the ambient noise ("Yes" at the step S53), the frequency component of the sound data is masked by the ambient noise, although it can be heard in the absence of the ambient noise. Accordingly, the correction coefficient is set so as to amplify the frequency component (S55). The calculation of the correction coefficient in this case is executed by formula (7).

$$\text{tmp_coef}[i] = F\left(\frac{\text{noise_thr}[i]}{\text{signal_power_smth}[i]}\right) \tag{7}$$

In this manner, the correction coefficient is calculated on the basis of the ratio between the masking threshold value of the ambient noise "noise_thr[i]" and the power of the smoothed sound data "signal_power_smth[i]". In formula (7), a function F( ) is a function which amplifies the spectral gradient of the smoothed sound data so as to become nearly parallel to the shape of the masking threshold value of the ambient noise. By way of example, a function as is indicated by formula (8) is considered.

$$F(x)=\alpha\cdot A^{\beta\cdot x+\gamma} \tag{8}$$

Here, "α" and "β" are positive constants, and "γ" is a constant which is either positive or negative. These constants are used for adjusting the degree of the amplification of the sound data. Incidentally, the correction coefficient may be weighted in accordance with a frequency band. The weighting according to the frequency band can be realized in such a way that the value of "α" in formula (8) is varied in accordance with the band in which the frequency component x is contained.

There is considered, for example, a case where the frequency component (100 Hz to 4 kHz) of the voice band is weighted and amplified. This case is useful when speech is to be clarified more than the background sound or the like of a program (for example, a news or talk program in a TV or radio broadcast). In this manner, the weight of the correction coefficient is made different, depending upon whether the frequency component is inside or outside the voice band, whereby the amplification of any sound other than the desired sound can be suppressed. Moreover, the voice band is more clarified by the weighting with formula (7), so that the frequency component which is masked by the sound data itself is not amplified even when it is a frequency component of the voice band.

In the correction coefficient smoothing part 35*d*, the correction coefficient tmp_coef[i] calculated by the correction coefficient calculation part 35*c* is smoothed. The correction coefficient tmp_coef[i] calculated by the correction coefficient calculation part 35*c* is sometimes discontinuous with respect to the correction coefficient tmp_coef[i+1] or tmp_coef[i−1] for the adjacent frequency component. In particular, a correction coefficient for a frequency component determined to be masked by the sound data itself and a correction coefficient for a frequency component determined to not be masked by the sound data itself are liable to be discontinuous if they are adjacent, because of their different calculation methods. In order to moderate the discontinuity, therefore, the correction coefficient is smoothed to suppress the deterioration of the quality of the sound data. The smoothing of the correction coefficient is performed by, for example, a weighted moving average as indicated by formula (9).

$$coef[i] = \frac{\sum_{j=i-L}^{j=i} b_j \cdot \text{tmp_coef}[j]}{\sum_{j=i-L}^{j=i} b_j} \tag{9}$$

The smoothing of the correction coefficients may be performed for all the frequency components, but it may be performed only in the around the boundaries between the frequency components masked by the sound data itself and the frequency components not masked. As stated before, the parts between the frequency components masked by the sound data itself and the frequency components not masked by the sound data itself are especially likely to be discontinuous, and hence, it is sufficiently effective to perform the smoothing only in the around the boundaries therebetween. When parts other than the around the boundaries are not smoothed, the fine structure of the spectrum of the sound data is not made smooth, and as a result a harmonic structure is difficult to collapse.

The spectrum of the sound data and the correction coefficient smoothed by the correction coefficient smoothing oart 35*d* are inputted to the correction operation part 35*e*. The sound data is corrected by multiplying the correction coefficient and the spectrum of the sound data as indicated in formula (10).

$$signal_r[i]=coef[i]\times signal_r[i]$$

$$signal_i[i]=coef[i]\times signal_i[i] \quad (10)$$

When the sound data is corrected by the correction operation part 35*e*, it is permissible not to correct the low-frequency components (for example, components lower than 100 Hz), or, when the low-frequency components are amplified, it is permissible to use an amplification factor less than a predetermined threshold value. Thus, a sound volume can be prevented from being widely altered by the amplification of the low-frequency components, to which human ears are sensitive.

As described above, when the frequency component of the sound data masked by the ambient noise is corrected, the signal of the frequency component masked by the sound data itself is not amplified, whereby the clarity of the sound data can be attained while preventing excessive sound volume amplification.

Second Embodiment

In description of the second embodiment below, an example is described in which a signal processing apparatus is provided in a portable telephone as in the first embodiment. The configuration of the portable telephone in the second embodiment is the same as the configuration of the portable telephone in the first embodiment, and its description is not repeated.

In the second embodiment, the masking threshold values of "noise recorded beforehand" (hereinafter, termed "recorded noise") are stored, and sound data is corrected using the stored masking threshold values of the recorded noise.

Figure 7:
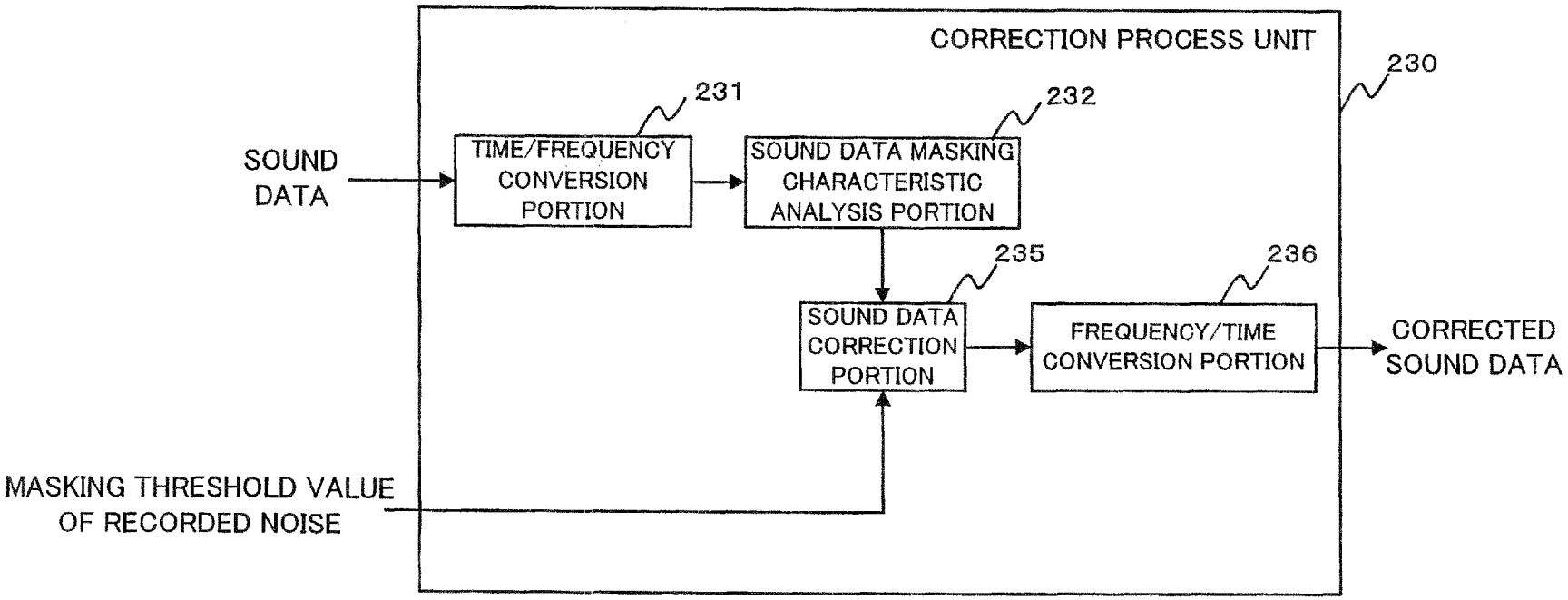
FIG. 7 is a block diagram showing the configuration of a correction process unit in a portable telephone according to the second embodiment of the invention.

A configuration diagram of a correction process unit 230 in the second embodiment is shown in FIG. 7. In the portable telephone according to the second embodiment, the masking threshold values of the recorded noise are stored in the storage unit 16. The correction process unit 230 in the second embodiment corrects the sound data by a sound data correction portion 235 with the masking threshold values of the recorded noise. That is, the sound data correction portion 235 performs a correction to amplify a frequency component having a power level which is greater than the masking threshold value of the sound data for the frequency component and which is less than the masking threshold value of the recorded noise for the frequency component.

The processing of a time/frequency conversion portion 231, a sound data masking characteristic analysis portion 232, the sound data correction portion 235, and a frequency/time conversion portion 236 are the same as the processing of the time/frequency conversion portion 31, the sound data masking characteristic analysis portion 32, the sound data correction portion 35 and the frequency/time conversion portion 36 in the first embodiment, respectively. Accordingly, detailed description thereof is omitted.

The recorded noise is data recorded for a long time (for example, 10 seconds or more) so as to avoid the influence of transient noise. The data is converted into a frequency domain as a sample, to calculate the masking threshold values.

The masking threshold value/values of the recorded noise to be stored in the storage unit 16 beforehand may be of only one type, or may be of a plurality of types. For example, if the portable telephone according to this embodiment is always used in the same place where the ambient noise does not change considerably, the masking threshold values are calculated using noise recorded under the typical environment, and the sound data is always corrected using the masking threshold values of the recorded noise.

On the other hand, if the portable telephone according to this embodiment is used under various environments, the masking threshold values of noise recorded under the various environments may be stored in the storage unit 16 so as to change-over the masking threshold values for use in the sound data correction portion 235 in accordance with the ambient noise. The masking threshold values for use in the sound data correction portion 235 may be determined by the manipulation of a user, or may be automatically decided.

In a case where the masking threshold values for use in the sound data correction portion 235 are determined by the user manipulation, the environments under which the noise of the plurality of types of masking threshold values were recorded (for example, "in an automobile", "in a house", and "in the outdoors") are stored in association with the masking threshold values when these masking threshold values are stored in the storage unit 16. In addition, information items on the recording environment stored in the storage unit 16 are displayed on the display unit 17 in accordance with the manipulation from the manipulation unit 15. The user can select one of the information items on the recording environment displayed on the display unit 17, by manipulating the manipulation unit 15. When one information item has been selected, the correction process in the sound data correction portion 235 is executed using the masking threshold values of the recorded noise stored in association with the information on the recording environment. Thus, the correction of the sound data can be adapted for the present environment.

On the other hand, in the case where the masking threshold values for use in the sound data correction portion 235 are determined in accordance with the ambient noise, the spectrums of the recorded noise used for calculating the plurality of sorts of masking threshold values are stored in association with the masking threshold values when these masking threshold values are stored in the storage unit 16. In addition, a microphone for acquiring the ambient noise is provided.

The ambient noise inputted from the microphone is converted from a time domain into a frequency domain, and the frequency domain data is compared with the spectrums of the plurality of sorts of recorded noise stored in the storage unit 16. The correction process of the sound data is executed by the sound data correction portion 235 with the masking threshold values of the recorded noise that is most similar to the ambient noise inputted from the microphone.

In this manner, the masking characteristic of the recorded noise for use in the correction of the sound data is automatically determined in adaptation to the ambient noise. Therefore, the masking threshold values of the appropriate recorded noise are automatically selected without requiring the manipulation of the user. The timing of determining the appropriate masking threshold values (of the appropriate recorded noise) may be each time one frame of reproduced data is processed, or may be each time a predetermined number of frames are processed.

In the case where which of the masking characteristics of the recorded noise is used is determined automatically in adaptation to the ambient noise in this manner, the microphone for inputting the ambient noise is required. Since, however, the ambient noise to be acquired by the microphone is used only for measuring the degree of similarity of the frequency characteristic to the recorded noise, the microphone need not be a high performance microphone. Even when the microphone cannot acquire a wide band ambient noise, the sound data correction portion 235 can use a wide band recorded noise to correct a wide band sound data.

With the structure of the embodiments described above, the amount of processing required when clarifying the sound data can be decreased. The invention is not restricted to the foregoing embodiments, but it may be appropriately altered within a scope not departing from the purpose thereof.

What is claimed is:

1. A method for processing sound data comprising:

determining a power and a first masking threshold for each frequency component of sound data;

obtaining a second masking threshold for each frequency component of an ambient noise;

determining whether each frequency component of the sound data is masked by at least one of the other frequency components of the sound data;

determining whether each frequency component of the sound data is masked by ambient noise;

setting correction coefficients for each frequency component of the sound data according to whether the frequency component is masked by at least one of the other frequency components of the sound data and whether the frequency component is masked by the ambient noise; and correcting the frequency components of the sound data by using the respective correction coefficients.

2. The method according to claim 1, wherein the set correction coefficient amplifies the frequency component which is determined to be masked by the ambient noise and not masked by at least one of the other frequency components of the sound data.

3. The method according to claim 1, wherein for each frequency component which is determined to be masked by the ambient noise and not masked by at least one of the other frequency components of the sound data, the correction coefficient is set according to a calculated ratio between the power of the frequency component and the second masking threshold of a corresponding frequency component of the ambient noise.

4. The method recited in claim 1 further comprising:

smoothing the correction coefficients after setting the correction coefficients.

5. A method for processing sound data comprising:

determining a power and a first masking threshold for each frequency component of sound data;

selecting one type of recorded noise from a plurality of types of recorded noise;

obtaining a second masking threshold for each frequency component of the selected type of recorded noise;

determining whether each frequency component of the sound data is masked by at least one of the other frequency components of the sound data;

determining whether each frequency component of the sound data is masked by the selected type of recorded noise;

setting correction coefficients for each frequency component of the sound data according to whether the frequency component is masked by at least one of the other frequency components of the sound data and whether the frequency component is masked by the selected type of the recorded noise; and correcting the frequency components of the sound data by using the respective correction coefficients.

6. The method recited in claim 5, wherein selecting the type of recorded noise comprises:

capturing an ambient noise signal by a microphone;

comparing a spectrum of the captured ambient noise signal and respective spectrums of the plurality of types of recorded noise; and selecting the type of recorded noise that has a spectrum similar to the captured ambient noise signal, from the plurality of types of recorded noise.

7. The method recited in claim 5, wherein the selected type of recorded noise is selected by a user.

* * * * *